US011299362B2

(12) United States Patent
Raul et al.

(10) Patent No.: US 11,299,362 B2
(45) Date of Patent: Apr. 12, 2022

(54) TENSION REGULATING DIRECTLY DRIVEN ROLLER FESTOON

(71) Applicant: Kimberly-Clark Worldwide, Inc., Neenah, WI (US)

(72) Inventors: Pramod R. Raul, Appleton, WI (US); Aaron Gander, Neenah, WI (US); Eric-John R. Gilgenbach, Winneconne, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 16/622,573

(22) PCT Filed: Jun. 23, 2017

(86) PCT No.: PCT/US2017/038996
§ 371 (c)(1),
(2) Date: Dec. 13, 2019

(87) PCT Pub. No.: WO2018/236389
PCT Pub. Date: Dec. 27, 2018

(65) Prior Publication Data

US 2020/0216281 A1 Jul. 9, 2020

(51) Int. Cl.
*B65H 23/188* (2006.01)
*B65H 21/00* (2006.01)
*B65H 20/34* (2006.01)

(52) U.S. Cl.
CPC ..... *B65H 23/1888* (2013.01); *B65H 21/00* (2013.01); *B65H 20/34* (2013.01);
(Continued)

(58) Field of Classification Search
CPC .... B65H 20/34; B65H 21/00; B65H 23/1888; B65H 2403/20; B65H 2403/30; B65H 2511/112; B65H 2513/10; B65H 2557/30
(Continued)

(56) References Cited

U.S. PATENT DOCUMENTS 3,998,368 A 12/1976 Hackney
4,915,282 A * 4/1990 Martin ..... B65H 20/34 226/1
(Continued)

FOREIGN PATENT DOCUMENTS

CN 103391892 A 11/2013
EA 000903 B1 6/2000
(Continued)

OTHER PUBLICATIONS

International Search Report Corresponsing to Application No. PCT/US2017/038996 dated Mar. 20, 2018.
(Continued)

*Primary Examiner* — George R Koch
(74) *Attorney, Agent, or Firm* — Dority & Manning, P.A.

(57) ABSTRACT

A web handling system and method for controlling tension in a web of material is disclosed. For instance, the web handling system is particularly well suited for maintaining web tension within predefined setpoints during temporary interruptions in the process, such as during splicing operations. The web handling system includes an accumulator or festoon that accumulates amounts of the material as the material is being fed downstream. At least one guide roll within the festoon is coupled to a drive device, such as a motor. The system also includes at least one tension sensing device. The drive device accelerates or decelerates the guide roll based upon information obtained from the tension sensing device. In one embodiment, the system further
(Continued)

includes an electronic gearing configuration between a roll of material being unwound and the guide roll within the festoon for better synchronization and further minimizing tension swings. The electronic gearing can include a diameter calculator for the roll of material being unwound based on speed feedback of a driven guide roll.

24 Claims, 9 Drawing Sheets

(52) U.S. Cl.
CPC ..... *B65H 2403/20* (2013.01); *B65H 2403/30* (2013.01); *B65H 2511/112* (2013.01); *B65H 2513/10* (2013.01); *B65H 2557/30* (2013.01)

(58) Field of Classification Search
USPC ..... 156/351, 361
See application file for complete search history.

(56) References Cited

U.S. PATENT DOCUMENTS 5,357,178 A * 10/1994 Kapitan ..... B65H 23/192 318/7
5,671,895 A 9/1997 Cedeerholm et al.
7,458,540 B2 12/2008 Weber et al.
2002/0037794 A1* 3/2002 Kawamura ..... B31F 1/2836 493/201
2002/0059013 A1* 5/2002 Rajala ..... B65H 20/34 700/122
2004/0030439 A1 2/2004 Vaidyanathan et al.
2004/0118892 A1* 6/2004 Weber ..... A61F 13/15772 226/44
2009/0101745 A1 4/2009 St. Germain
2010/0138036 A1 6/2010 Schulze

FOREIGN PATENT DOCUMENTS

WO WO97/3280 A1 9/1997
WO WO03/033384 A1 4/2003
WO WO2005/056447 A1 6/2005

OTHER PUBLICATIONS

Russian Office Action Corresponding to Application No. 2020100002 dated Nov. 9, 2020.
Chinese Search Report Corresponding to Application No. 201780091293 dated Mar. 21, 2021.
International Report of Patentability Corresponding to Application No. PCT/US2017/038996 dated Apr. 2, 2019.
European Search Report Corresponding to Application No. 17814419 dated May 29, 2021.

* cited by examiner

TENSION REGULATING DIRECTLY DRIVEN ROLLER FESTOON

RELATED APPLICATIONS

The present application is based upon and claims priority to PCT International Patent Application No. PCT/US2017/038996, filed on Jun. 23, 2017, which is incorporated herein by reference.

BACKGROUND

The manufacture of products such as disposable absorbent articles involves the use of flexible materials. The flexible materials can include, by way of illustration, non-woven materials, elastic materials, adhesive tapes, polymeric films, release paper, mechanical fastening materials, paper webs, and the like. During the formation of products, these materials are typically unwound from relatively large rolls of material and fed into a process where the material is manipulated, possibly combined with other materials, and formed into products.

When feeding a roll of material into a process, typical unwind systems may include an unwind device that is configured to hold a roll of material and to unwind the material. Such systems can also include a splicing device and a festoon.

The splicing device is for splicing a first material to a second material when the roll containing the first material is exhausted and needs to be replaced by a second full roll of material.

Festoons, which may be placed downstream of the unwind device are designed to accumulate and temporarily hold a limited length of the material. The accumulated material is then released or additional length is accumulated when processing of the continuous material is temporarily interrupted. Such temporary interruptions can be, for example, when splicing a first material to a second material.

Festoons can include, for instance, a row of top idler rolls spaced from a row of bottom idler rolls. The top idler rolls are connected to a carriage that allows the rolls to move towards and away from the bottom idler rolls. The material is threaded through the festoon by passing back and forth between the bottom idler rolls and the top idler rolls. In this manner, the festoon is capable of accumulating the needed amount of material. In order to release the material, the top idler rolls move towards the bottom idler rolls decreasing the amount of material held in the festoon. Likewise, in order to increase the capacity of the festoon, the top idler rolls may move away from the bottom idler rolls.

During, for instance, a splice operation, a first roll of material is decreased in speed from the process speed to a slower speed or even stopped. Once the speed of the web is lowered, a splicing device splices a second roll of material to the first roll of material. During this time, material accumulated in the festoon continues to feed material into the process without interruption. The second roll of material is then accelerated to process speed. The second roll of material may be accelerated to a rate greater than the process speed in order to re-supply the festoon. If so, once the festoon has accumulated a sufficient amount of material, the unwind speed of the second roll of material is decreased to the process speed. During the above splicing operation, the idler rolls contained in the festoon are accelerated and decelerated in conjunction with the rate at which the material is unwound.

The web speed changes that occur during a splice sequence can cause problems in web handling due to tension upsets in the system. Low basis weight materials, such as low modulus non-woven webs, are susceptible to tension swings that can cause the web to become damaged. For example, tension variations can occur due to spindle acceleration and deceleration, idle roll inertia, bearing friction, air drag, and the like. Tension fluctuations when transporting lightweight webs at high speeds can make the web material susceptible to "neck down" when tension increases and to wrinkles or foldovers when tension decreases. Thus, there is a need to regulate and control tension during the splice sequence, during machine acceleration or deceleration phases, and during steady state running conditions in order to avoid material damage and/or downtime of the system due to material damage or process fluctuations.

SUMMARY

The present disclosure is generally directed to a system and process for unwinding a roll of material. More particularly, the present disclosure is directed to a system and process for controlling and regulating tension in a web of material being unwound and fed to a process, especially during temporary interruptions or speed changes in the web during the process. The system and process of the present disclosure, for instance, are particularly well suited for feeding materials into a processing line during the construction of absorbent articles.

In one embodiment, the present disclosure is directed to a web handling system that includes a tension sensing device that monitors tension in a web of material being fed into a process. The tension sensing device, for instance, may comprise a load cell. The load cell can be placed in operative association with a roller over which the web of material travels.

The web handling system can further include a festoon or accumulator. The festoon can comprise a first set of guide rolls spaced from a second set of guide rolls. The first set of guide rolls and the second set of guide rolls can be movable towards and away from each other. The festoon accumulates amounts of the material sufficient to sustain temporary stoppages during an unwind process. The festoon may include at least about four guide rolls. For example, the festoon can include an upstream guide roll, a plurality of midstream guide rolls, and a downstream guide roll.

In accordance with the present disclosure, a drive device is coupled to at least one guide roll, such as the upstream guide roll. The drive device, for instance, may comprise a motor that is directly coupled to the guide roll or coupled through a linking belt, such as a belt, chain, or gearbox. In accordance with the present disclosure, the system further includes a controller configured to receive information from the tension sensing device and, based on the information, control the drive device in order to accelerate and/or decelerate the driven guide roll in order to control the tension in the web.

In one embodiment, the system can further include an unwind device for unwinding a roll of material. The unwind device can be located upstream of the tension sensing device. The system can further include a velocity sensing device for monitoring a velocity of the web of material being unwound from the unwind device. The velocity sensing device can be in communication with the controller. The controller can receive information from the velocity sensing device and, based on the information, control the drive device in a manner such that the velocity of the web of material being unwound substantially matches the velocity of the web traveling over the upstream guide roll. As used herein, the term "substantially matches" indicates that the velocity of the web at the upstream guide roll is within 50% (±50%) of the velocity of the web at the unwind device. In one embodiment, for instance, the velocity of the web at the upstream guide roll is from about 50% less to about 50% greater, such as from about 10% less to about 10% greater than the velocity of the web at the unwind device.

In one embodiment, the unwind device includes a driven spindle. The roll of material can be placed on the spindle for unwinding the material and feeding the material into the process. In one embodiment, the velocity sensing device can measure the rotational speed of the spindle during the process and the diameter of the roll of material being unwound can be calculated or measured for use in determining whether the drive device should influence the rotational speed of the upstream guide roll. Substantially matching the velocity of the web at the unwind device with the velocity of the web at the upstream guide roll further reduces tension fluctuations and variations in the system.

In one embodiment, the system can include at least one other drive device. For instance, a second drive device can be coupled to a second guide roll, such as one of the midstream guide rolls or the downstream guide roll. The system can include a second tension sensing device. The second tension sensing device can be positioned upstream or downstream from the second guide roll. The controller can be configured to receive information from the second tension sensing device and, based on the information, accelerate and/or decelerate the second guide roll coupled to the second drive device for further controlling tension within the festoon and downstream.

The controller incorporated into the system can comprise any suitable programmable device. For instance, the controller can comprise one microprocessor or a plurality of microprocessors operating in conjunction with the web handling system.

In one embodiment, the system can include a first unwind device for unwinding a first roll of material and a second unwind device for unrolling a second roll of material. Each of the unwind devices can be in communication with a splicing device. The splicing device is for splicing the rolls of material together to continue to feed the material into the process with only temporary interruptions in the velocity of the web of material. The web handling system as described above allows for the splicing operation to occur without any interruption in the downstream processing of the web while controlling tension in the web to prevent damage to the web or to prevent any other process disruptions.

The present disclosure is also directed to a method for unwinding a roll of material into a downstream process. The method includes the step of unwinding a web of material from a roll. Tension in the web of material is monitored while the roll is being unwound at a first location. The web of material is fed into a festoon. The festoon includes a plurality of rotatable guide rolls including an upstream guide roll, a plurality of midstream guide rolls, and a downstream guide roll. In accordance with the present disclosure, one of the guide rolls is actively accelerated or decelerated based upon the monitored tension in the web. The guide roll, for instance, can be accelerated or decelerated by a drive device coupled to the roll. The drive device, for instance, may comprise a motor. The guide roll is accelerated or decelerated in order to control and regulate tension of the web as it is fed through the festoon.

In one embodiment, the method can further include the step of monitoring a velocity of the web of material being unwound by an unwind device. The guide roll can be controlled by the drive device such that the velocity of the web of material at the unwind device substantially matches the velocity of the web of material at the upstream guide roll.

In one embodiment, the method or process can further include monitoring the tension of the web at a second location. A second guide roll can then be accelerated or decelerated based upon the monitored tension. The second guide roll can be accelerated or decelerated using a second drive device. In this manner, the tension of the web within the festoon can be further controlled and regulated.

In one embodiment, the upstream guide roll and one or more midstream guide rolls or the downstream guide roll can be controlled by the drive devices during a splicing procedure in order to control tension in the web. During a splicing operation, a first roll of material can be unwound using a first unwind device. The rate at which the roll of material is unwound is then decreased causing an accumulated amount of material contained in the festoon to be released in order for the downstream speed of the material to remain substantially unchanged. A second roll of material on a second unwind device is spliced to the first roll of material and unwound. In accordance with the present disclosure, one or more guide rolls in the festoon are actively decelerated when the rate at which the first roll of material is unwound decreases. The one or more guide rolls are actively decelerated by corresponding drive devices based upon monitored tension in the web and optionally also based upon the velocity of the web at the first or second unwind device.

After the second roll of material is spliced to the first roll of material, the second roll of material is accelerated using a second unwind device. The driven guide roll is then actively accelerated in order to follow a speed of the unwinding material and control tension in the material.

In one embodiment, the system can include more than two drive devices. For example, the system can include a third drive device for actively accelerating or decelerating a third guide roll. The system can include a third tension sensing device that can be positioned upstream or downstream from the third guide roll. The controller can be configured to receive information from the third tension sensing device and, based on the information, control the third drive device in order to accelerate or decelerate the third guide roll as a web of material is traveling through the festoon.

In general, the system of the present disclosure can include a drive device and a corresponding tension sensing device for each guide roll contained within the festoon. A single controller or multiple controllers can be used to control all of the drive devices.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
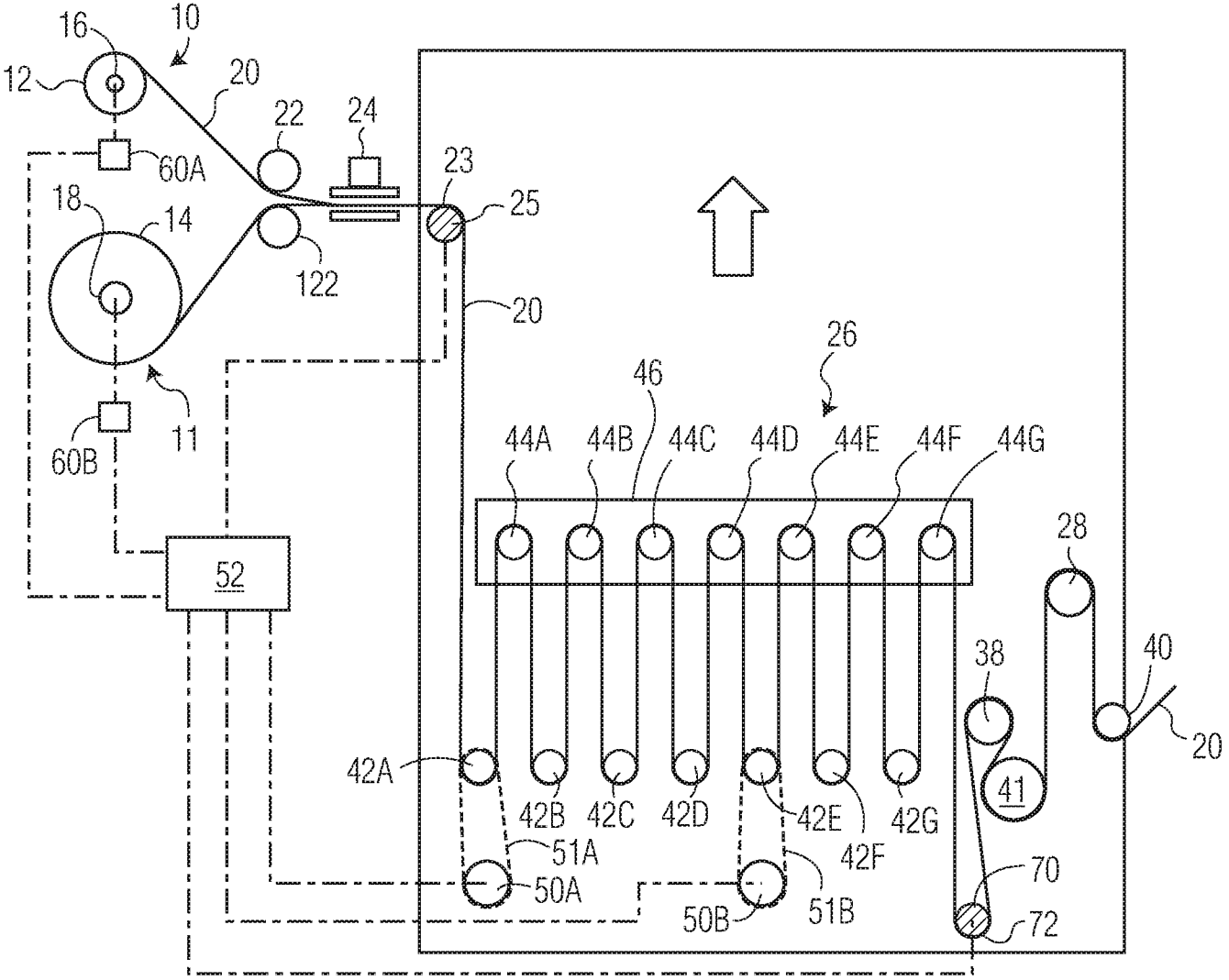
FIG. 1 is a side view of one embodiment of an unwind system made in accordance with the present disclosure.

Repeat use of reference characters in the present specification and drawings is intended to represent the same or analogous features or elements of the invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to an unwind system designed to feed a material into a process. Any suitable material may be unwound in accordance with the present disclosure. For example, representative of materials that may be processed according to the present disclosure include nonwoven materials, elastic materials, adhesive tapes, polymeric films, mechanical fastening materials, paper webs, tissue products, and the like. These materials may be fed into a process during the formation of various different types of products. For example, the materials may be fed into a process and manipulated in order to form personal care articles, diapers, incontinence pads, feminine hygiene products, tissue products, and the like.

The system of the present disclosure generally includes an unwind device that is configured to unwind a roll of material. From the unwind device, the material is fed into a festoon and optionally around a dancer roll prior to undergoing downstream processing.

The festoon contained in the system is designed to hold, at steady-state operation, an accumulation of the material being fed into the process. The festoon is also designed to release the material or accumulate greater amounts of the material should there exist a speed difference between the rate at which the material is being unwound and the rate at which the material is being processed downstream.

For example, in many processes, it is desirable to feed the material into a downstream process at constant speed. The festoon may be used to ensure that the speed of the web remains unchanged even if the unwind device temporarily stops unwinding the material or, alternatively, temporarily accelerates the rate at which the material is unwound. For example, unwind devices are normally interrupted when a first roll of material is exhausted and it becomes necessary to splice a second full roll of material to a nearly unwound first roll of material.

Festoons typically contain a first row of guide rolls spaced from a second row of guide rolls. The material being unwound is threaded back and forth through the guide rolls which allows for an accumulation of the material. In one embodiment, the top guide rolls may be associated with a carriage that moves towards and away from the bottom guide rolls. Alternatively, the bottom guide rolls may be associated with a carriage that moves towards and away from the top guide rolls. In still another embodiment, the top guide rolls and the bottom guide rolls may move towards and away from each other. When the different sets of guide rolls move toward each other, the amount of material stored in the festoon is reduced. When the different sets of rolls move away from each other, on the other hand, the amount of material stored in the festoon is increased.

In order to accumulate or release material from the festoon, the speed of the web of material entering the festoon can be changed. For instance, increasing the speed of the web of material being fed to the festoon causes the festoon to accumulate greater amounts of material. In one embodiment, for instance, a roll of material is fed to the festoon from a rotating spindle. The rotational speed of the spindle, therefore, can have a direct impact upon the festoon position.

During steady-state processing, each of the guide rolls rotate at approximately the same speed and the carriage remains in a set position. During interruptions in the rate at which the material is unwound, however, material in the festoon is either released or the amount of material stored in the festoon is increased. During these occurrences, the speed of the guide rolls vary from roll to roll. For example, should a temporary stoppage occur of the unwind device, the speed of the guide rolls may vary from zero at the upstream end to full speed at the downstream end.

In the past, the buildup of material tension through the festoon was used in order to decelerate the guide rolls and a reduction of material tension was used in order to accelerate the guide rolls. Thus, during unwind interruptions, tension swings occurred in the festoon. The minimum and maximum tension in the material is a function of the unwind deceleration and acceleration rates, guide roll inertia, festoon capacity, machine speed, festoon pressure, bearing drag, air drag, and other factors. These tension swings during temporary interruptions in the process can cause the web material to neck when tension increases or causes the web material to form fold overs and wrinkles when there is a drop in tension. In fact, tension swings in materials with a low strength can cause breaks to occur resulting in the complete shutdown of the process.

In this regard, the present disclosure is directed to a method and system for controlling tension in a web of material that is being fed through a festoon and into a downstream process. As will be explained in detail below, the method and system of the present disclosure allows for web materials to be processed at faster speeds while mitigating any disturbances in the web thereby minimizing web fold overs, wrinkles, web breaks, and the like.

In one embodiment, a festoon made in accordance with the present disclosure includes a tension control strategy that is independent of the speed of the material running through the festoon and the material properties. In accordance with the present disclosure, at least one drive device is coupled to at least one guide roll within the festoon, such as the farthest upstream guide roll. The drive device is coupled to the guide roll for accelerating and decelerating the roll when tension fluctuations occur, such as during splice operations and other interruptions in web speed. The system can further include a tension sensing device, such as a load cell. The load cell provides feedback to the drive device so that the directly driven roller within the festoon can regulate tension with proportional and integral control strategy. In one embodiment, the system and method can further include electronic gearing between a roll of material being unwound and the one or more drive devices within the festoon. The electronic gearing is used to match speeds of the web of material at the unwind device and at the drive device. Using electronic gearing feedback to match speeds of the web at different locations in the system allows for better synchronization and less impact on web tension. In one embodiment, the speed of the web of material at the unwind device is calculated using ratio detector diameter based on encoder feedback. As will be explained in more detail below, the diameter calculator generates more effective speed reference for better control and regulation in tension in downstream spans.

Figure 2:
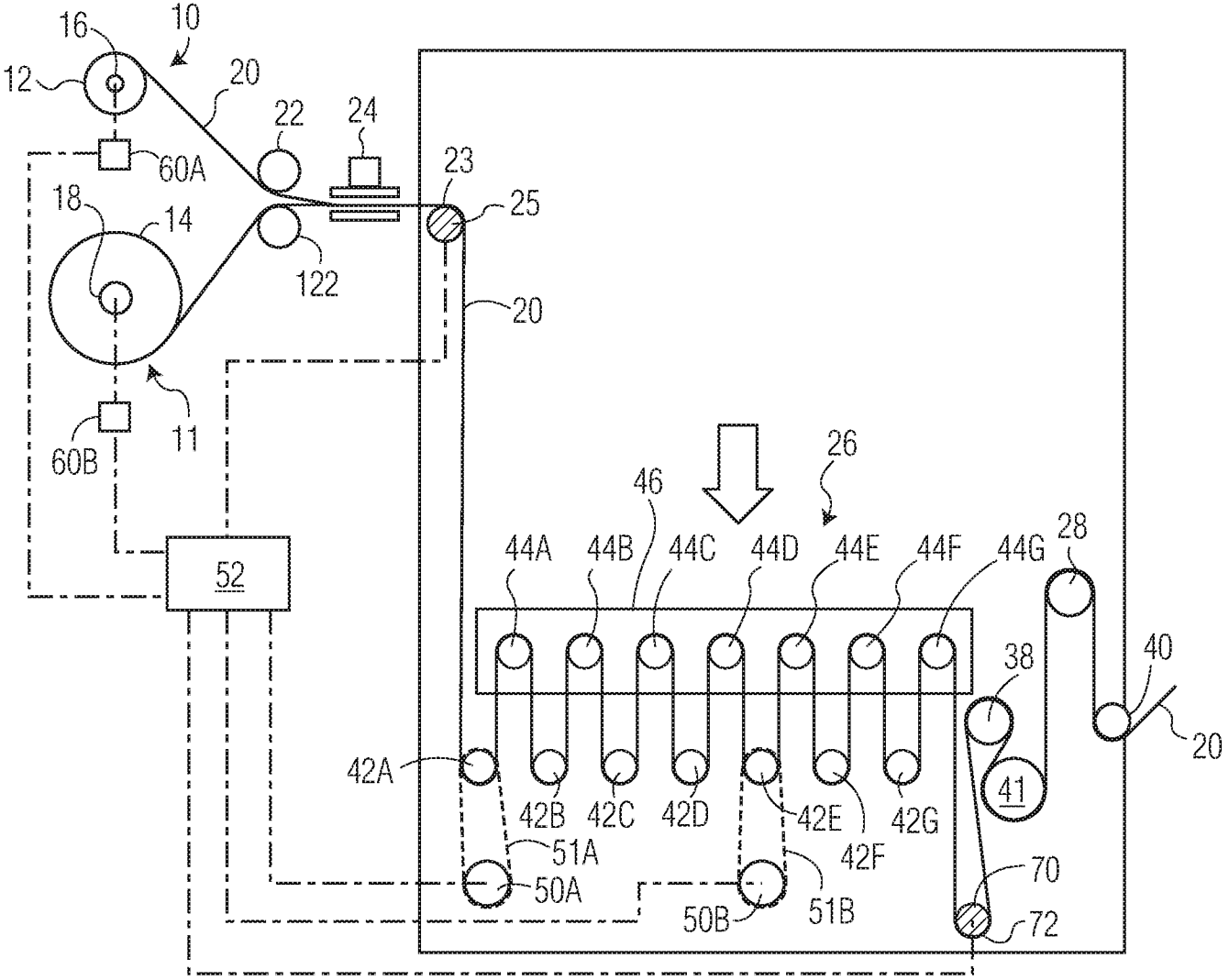
FIG. 2 is a side view of the embodiment illustrated in FIG. 1 illustrating the guide rolls moving towards each other.
Figure 3:
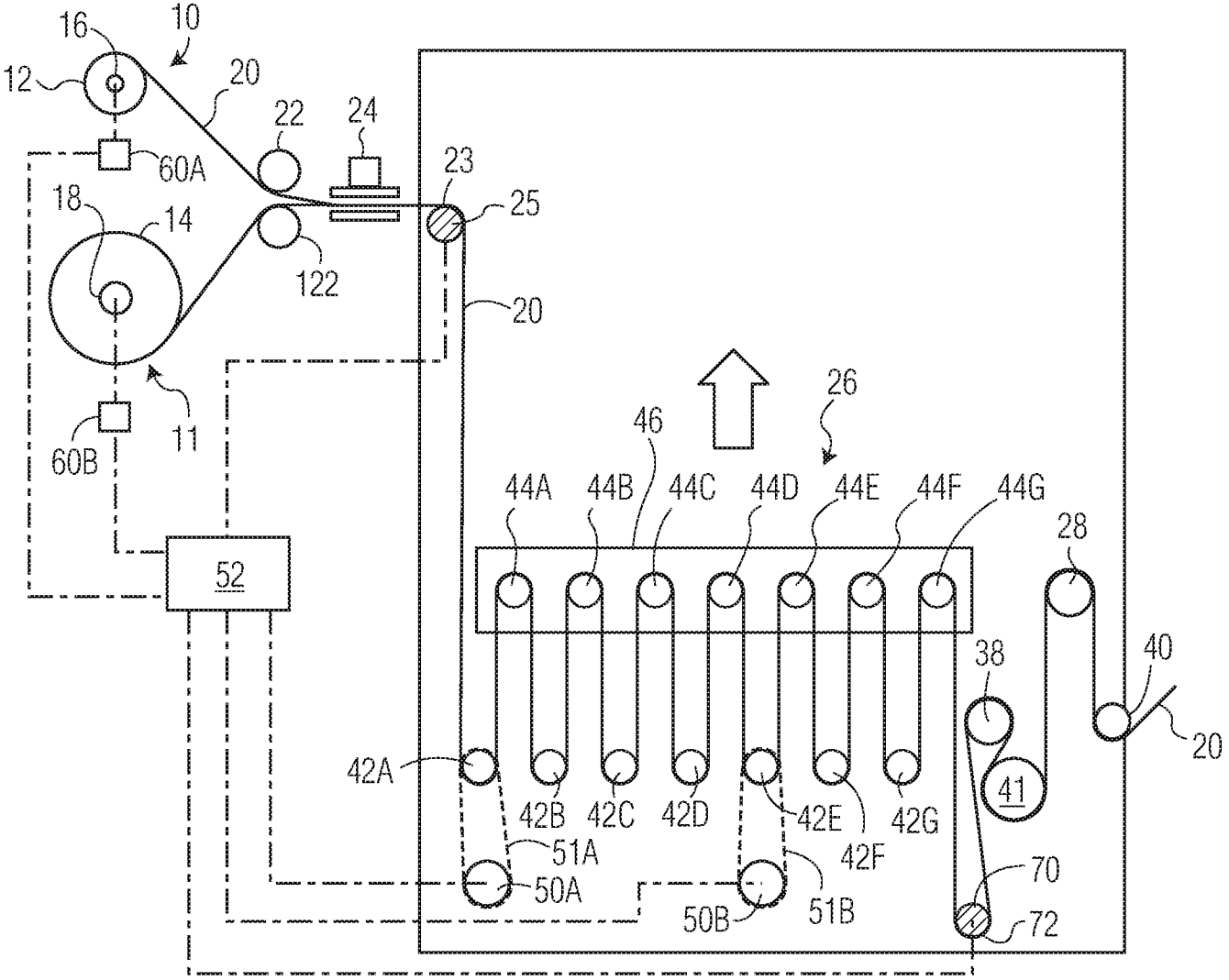
FIG. 3 is another side view of the embodiment of the unwind system shown in FIG. 1.

Referring to FIGS. 1-3, one embodiment of an unwind system made in accordance with the present disclosure is illustrated. As shown, in this embodiment, the system includes a first unwind device 10 for unwinding a first roll of material 12 and a second unwind device 11 for unwinding a second roll of material 14. The second roll of material 14 is a staging roll that is spliced to the first roll of material 12 when the first roll of material becomes exhausted. In this manner, a web material can be continuously fed into the process.

The first unwind device 10 includes a spindle 16 that is designed to hold the roll of material 12. Similarly, the second unwind device 11 includes a spindle 18 for holding and unwinding the second roll of material 14. For example, in one embodiment, each unwind device can include a center unwind drive mechanism that rotates the spindles 16 and 18 in order to unwind the material. Alternatively, the drive mechanism may comprise a surface unwind device that engages an exterior surface of the rolled material for unwinding the material. For example, in one embodiment, the surface unwind device may comprise a moving belt that is brought into contact with the roll of material. In still another embodiment, a center unwind device may be used in conjunction with a surface unwind device.

As shown in FIG. 1, a material 20 is unwound from the roll 12 and fed around an idler roll 22. From idler roll 22, the material 20 passes through a splicing device 24. Splicing device 24 is for splicing the rolls of material together when one of the rolls is exhausted. Thus, the splicing device 24 is activated at periodic intervals.

From the splicing device 24, in this embodiment, the web of material 20 engages a roller 23. At or near the roller 23, the system can include a tension sensing device 25. The tension sensing device 25 measures the tension in the web of material. In general, any suitable tension sensing device may be used. In one embodiment, for instance, the roller 23 can be placed in operative association with a load cell that can be used to measure or derive tension in the web.

From the roller 23, the material is fed through a festoon generally 26, around a driven feed roll 41, a dancer roll 28, and an idler roll 40. As shown, the material is in an S-wrap configuration when passing over the driven feed roll 41 due to the position of the roller 38. The material 20 can be wrapped at least about 180 degrees around the feed roll 41. The speed of advance of the material 20 is influenced by the unwind device 10 in combination with the driven feed roll 41. Once exiting the idler roll 40, the material 20 is manipulated and processed as desired in order to form a desired product or article.

The primary purpose of the dancer roll 28 is to attenuate tension disturbances in the web 20. Such tension disturbances might come, for example, unintended, but none the less normal vibrations emanating from equipment downstream, raw material variability, wound roll variances, and variability in bearing drag and variability in tension exiting the festoon. The dancer roll 28 applies a force against the material 20 for feeding the material 20 into the process under substantially constant tension.

In one embodiment, the dancer roll 28 can be placed in association with a device that applies an upward force to the roll 28. For instance, the roll 28 can be placed in association with one or more pneumatic or hydraulic cylinders. The one or more cylinders can apply a force to the dancer roll 28 which is then applied to the web 20.

The dancer roll 28 is movable towards and away from the driven feed roll 41 and the idler roll 40 which are in a fixed position. In general, to the extent the process take-away speed exceeds the speed at which the material is supplied to the dancer roll, the static forces on the dancer roll cause the dancer roll to move downwardly within its operating window. In one embodiment, as the dancer roll moves downwardly, the change in position may be sensed by, for example, a position transducer, which sends a corrective signal to the driven feed roll 41 to increase in speed. The speed of the driven feed roll increases enough to return the dancer roll to the midpoint of its operating window.

By corollary, if the take-away speed lags the speed at which the material is supplied to the dancer roll, the static forces on the dancer roll cause the dancer roll to move upwardly within its operating window. As the dancer roll moves upwardly, the change in position may be sensed causing the driven roll 41 to decrease in speed, thereby returning the dancer roll to a steady-state position.

By maintaining the dancer roll 28 at the same position with respect to the idler roll 40, tension within the web of material 20 is maintained substantially constant, even if the downstream speed of the web changes. In an alternative embodiment, the dancer roll may be eliminated. In this embodiment, the festoon itself may be used in order to maintain the web at a relatively constant tension.

As described above, the purpose of the festoon 26 is to accumulate a determined length of the material 20. Based upon the speed differences between the material 20 at the unwind device 10, at the feed roll 41, and at a downstream position, the festoon 26 is designed to either release the material contained in the festoon or to accept larger amounts of the material in the festoon. For example, should the unwind speed be less than the downstream process speed of the material, the festoon 26 releases the material. Alternatively, if the unwind speed is greater than the downstream process speed, the festoon is configured to increase in capacity. In this manner, speed changes can occur at the unwind device 10 without affecting the downstream speed of the material being fed into the process.

As shown in FIG. 1, the festoon 26 includes a row of bottom guide rolls 42A, 42B, 42C, 42D, 42E, 42F and 42G, and a set of top guide rolls 44A, 44B, 44C, 44D, 44E, 44F, and 44G. For example, the festoon 26 can include an upstream guide roll 42A, a downstream guide roll 44G, and a plurality of midstream guide rolls inbetween. In this embodiment, the top guide rolls 44 are all connected to a carriage 46. The carriage 46 is movable towards and away from the bottom guide rolls 42. The bottom guide rolls 42 are in a fixed position. Not shown, the carriage 46 may be placed in operative association with one or more fluid cylinders or weights. Each cylinder or weight provides an upward force on the carriage which is offset by the web tension.

As illustrated, the material 20 is threaded back and forth between the bottom guide rolls 42 and the top guide rolls 44. In this manner, the festoon 26 accumulates a determined length of material. When the carriage 46 moves towards the bottom guide rolls 42, material contained within the festoon 26 is released to the process. Alternatively, when the carriage 46 is moved away from the bottom guide rolls 42, the capacity of the festoon 26 increases and a greater length of material is accumulated in the festoon.

During steady-state operation, the festoon 26 may operate similar to the dancer roll 28. In particular, if the festoon carriage 46 moves down due to web tension, the unwind device may be configured to automatically increase the speed at which the material is unwound. Similarly, if the carriage 46 moves up due to web tension, the unwind device may be configured to automatically decrease the speed at which the material is unwound in order to maintain the carriage in a predetermined position. In this manner, in some embodiments, the dancer roll 28 may be eliminated from the system.

In the embodiment shown, the festoon 26 includes fourteen (14) guide rolls. It should be understood, however, that more or less guide rolls may be contained in the festoon. For example, in other embodiments, the festoon can contain from about two (2) to about twenty (20) rolls, and particularly from about four (4) rolls to about eighteen (18) rolls.

In accordance with the present disclosure, at least one of the guide rolls within the festoon 26 is coupled with a drive device. For example, in one embodiment as shown in FIGS. 1-3, the upstream guide roll 42A can be coupled to a drive device 50A. The drive device 50A is for controlling the deceleration and/or the acceleration rate of the guide roll 42A. Although described herein as connected to guide roll 42A, it should be understood that any of the midstream guide rolls 42B-42G, 44A-44F may be connected to the drive device 50A instead of the upstream guide roll 42A in other embodiments.

The drive device 50A accelerates and/or decelerates the upstream guide roll 42A in response to tension fluctuations that are sensed in the web of material 20. For instance, the drive device 50A can be used to accelerate and/or decelerate the upstream guide roll 42A during splice sequences, during other temporary interruptions of the unwind process or during process shutdowns and startups. Actively increasing or decreasing the rotational speed of the upstream guide roll 42A allows for better tension control and regulation and can minimize tension swings through the festoon.

In accordance with the present disclosure, the upstream guide roll 42A is controlled by the drive device 50A based on changes in tension of the web of material upstream or downstream from the guide roll 42A. For example, as shown in FIGS. 1-3, the drive device 50A is in communication with a controller 52. Similarly, the tension sensing device 25 is also in communication with the controller 52. The controller 52, in this manner, is configured to receive information from the tension sensing device 25 and, based on the information, to control the drive device 50A for accelerating and/or decelerating the upstream guide roll 42A. Thus, when tension fluctuations are sensed in the web of material 20 by the tension sensor 25, the rotational speed of the upstream guide roll 42A can be changed and modified in order to counteract the tension fluctuations and return the web of material 20 to a constant tension state.

As one example, when the tension sensing device 25 senses a decrease in a present web tension value, the controller 52 may control the drive device 50A causing the drive device 50A to speed up the rotational speed of the guide roll 42A. Alternatively, when the tension sensing device 25 senses an increase in a present web tension value, the controller 52 may control the drive device 50A causing the guide roll 42A to slow down.

Additionally, it should be understood that in some embodiments, the tension sensing device 25 may be positioned downstream of the drive device 50A. In such embodiments, the control of the drive device 50A may be opposite that for embodiments where the tension sensing device 25 is positioned upstream of the drive device 50A, in terms of speeding up and slowing down in relation to a changing sensed web tension. That is, when the tension sensing device 25 senses a decrease in a present web tension value, the controller 52 may control the drive device 50A causing the guide roll 42A to slow down. When the tension sensing device 25 senses an increase in a present web tension value, the controller 52 may control the drive device 50A causing the guide roll 42A to speed up.

The controller can be, for instance, any suitable programmable device such as a microprocessor. Further, the controller 52 can be a single programmable device or a plurality of programmable devices. In one embodiment, the system of the present disclosure is a closed loop system where the controller automatically makes changes and controls the drive device 50A based upon input from the tension sensing device 25 so as to maintain the web of material 20 within a tension setpoint range.

The drive device 50A may be any suitable device that is capable of either accelerating or decelerating a guide roll. For example, when the drive devices are configured only to decelerate the guide rolls, the drive devices can comprise brake devices. Suitable brake devices include any friction brakes or mechanical brakes. Other brake devices may include piezoelectric devices.

When it is desirable to not only decelerate the guide rolls but also to accelerate the guide rolls, the drive device may comprise a motor. Suitable motors that may be used include DC stepper motors or servo motors. In the embodiment illustrated in FIGS. 1-3, a drive device 50A is coupled to the upstream guide roll 42A by a linking belt 51A. The linking belt 51A can be, for instance, a belt, a chain, or any other suitable coupling device. Alternatively, the drive device 50A can be coupled to the upstream guide roll 42A by a gear box. In still another embodiment, the drive device 50A can be directly coupled to the upstream guide roll 42A.

In one embodiment, the upstream guide roll 42A can be controlled not only in response to information received from the tension sensing device 25, but can also be controlled in relation to the velocity at which the web of material 20 is unwound from the roll of material 12 at the unwind device 10. For example, as shown in FIGS. 1-3, the system can further include velocity sensing devices 60 that sense the velocity of the web of material 20 being unwound. For example, the first unwind device can include a velocity sensing device 60A while the second unwind device 11 can include a velocity sensing device 60B. The velocity sensing devices 60A and 60B can be in communication with the controller 52. The controller 52 can be further programmed or configured to control the drive device 50A such that the speed of the web at the upstream guide roll 42A substantially matches the speed of the web at the respective unwind device. For example, the system can be operated such that the speed of the web of material 20 at the upstream guide roll 42 is from about 50% less to about 50% greater than the speed of the web of material 20 at the unwind device. More particularly, the speed of the web at the upstream guide roll 42A can be from about 10% greater to about 10% less than the speed of the web 20 at the unwind device, such as from about 5% greater to about 5% less than the speed of the web 20 at the unwind device.

Substantially matching the speed of the moving web 20 at the unwind device with the speed of the web at the entrance to the festoon can also serve to eliminate tension swings or tension fluctuations that may be experienced in the web. In particular, substantially matching the speeds of the web at the different locations can maintain and regulate span tension between the two driven rollers, i.e., the unwind spindle and the driven upstream guide roll.

In general, any suitable velocity sensing device 60 may be used in the system of the present disclosure. The velocity sensing device, for instance, may comprise a laser speed sensor, a contact wheel that contacts the web as it is moving, an encoder on a guide roll, or the like. In one embodiment, for instance, the speed of the web of material 20 is substantially matched at the different locations by monitoring the rotational speed of the spindle 16 at the unwind device 10. For instance, in one embodiment, the system of the present disclosure can include a type of electronic gearing that electronically couples the unwind spindle 16 with the drive device 50A in order to provide better synchronization and less impact on web tension. In one embodiment, for instance, the system of the present disclosure can include a diameter calculator of the unwind roll that generates more effective speed reference for use in controlling the drive device 50A.

For instance, especially during splicing operations, the diameter of the roll of material being unwound can influence tension performance in the system. In this regard, one aspect of the present disclosure is directed to better synchronization between the unwind device and the driven roller for producing lower tensions at higher speeds. The electronic gearing is set up such that the unwind spindle 16 is the master axis while the drive device 50A is the slave axis. A gear ratio between the two rotating component parts is determined by calculating the diameter of the unwind roll.

For example, in one embodiment, the diameter of the roll being unwound is determined by calculating a ratio between the velocity or speed of the web of material 20 at the upstream guide roll 42A and the rotational speed of the spindle 16 at the unwind device 10. The speed of the web 20 at the upstream guide roller 42A, for instance, can be obtained by an encoder associated with the drive device 50A, which can be multiplied by the guide roll diameter.

Once the diameter of the roll of material being unwound is calculated, electronic gearing can occur between the spindle 16 at the unwind device 10 and the drive device 50A such that the speed of the web at the unwind device substantially matches the speed of the web at the entry point of the festoon or at the upstream guide roll 42A. As shown in FIGS. 1-3, these calculations can be performed by the controller 52. The controller 52 can also be configured to automatically control the drive device 50A and/or the spindle 16 in order to control and regulate tension. Thus, in one embodiment, the drive device 50A can be controlled by the controller 52 based not only on information received from the tension sensing device 25 but also from the velocity sensing devices 60A and 60B. In one embodiment, for instance, the controller can be configured to accelerate or decelerate the guide roll 42A using the drive device 50A based upon information received from the velocity sensing devices 60A and 60B. In this regard, the controller can be configured to substantially match the speed of the web being unwound with the speed of the web passing over the guide roll 42A. Substantially matching the speed of the web at two locations can prevent against tension fluctuations and thus prevent the controller from having to make adjustments to the drive device 50A based upon information received from the tension sensing device 25. In this regard, during steady state, the drive device 50B is generally controlled by the controller 52 from information received from the velocity sensing devices 60A and 60B. Information received from the tension sensing device 25, on the other hand, can be used to make further adjustments when tension fluctuations are noticed.

During process interruptions, such as during splicing events, however, the controller 52 can be configured to control the drive device 50A primarily due to information received from the tension sensing device 25. In still another embodiment, the controller 52 can be programmed to use information received from the tension sensing device 25 and the velocity sensing devices 60A and 60B in a manner wherein the information is used together to control the drive device 50A.

In one embodiment, the web handling system of the present disclosure can include only a single drive device 50A in conjunction with one of the guide rolls 42 or 44. In other embodiments, however, further drive devices may be incorporated into the festoon for regulating and controlling tension. For instance, referring to FIGS. 1-3, a midstream guide roll 42E is shown coupled to a drive device 50B by a linking belt 51B. The drive device 50B is in communication with the controller 52.

As also shown in FIGS. 1-3, the system includes a second tension sensing device 70 that may be located in association with a guide roll 72. The tension sensing device 70 and the guide roll 72 are positioned downstream from the festoon 26. The tension sensing device 70 is also in communication with the controller 52. In one embodiment, the tension sensing device 70 can comprise a load cell integrated into the guide roll 72.

In the embodiment illustrated in FIGS. 1-3, the second tension sensing device 70 is positioned downstream from the drive device 50B and located outside of the festoon 26. It should be understood, however, that the tension sensing device can be placed at many different locations within the system. For example, the tension sensing device 70 may be located within the festoon 26 and can be positioned upstream or downstream from the drive device 50B. In addition, the tension sensing device 70 can be positioned along the bottom guide rolls 42 or along the top guide rolls 44.

In one embodiment, the controller can be configured to receive information from the tension sensing device 70 and, based on the information, control the drive device 52 for accelerating or decelerating the midstream guide roll 42E based on any tension fluctuations that are noticed in the web. Thus, the system illustrated in the figures includes a first drive device 50A for regulating and correcting tension fluctuations as the web of material 20 enters the festoon 26 and a second drive device 50B for regulating and mitigating tension fluctuations that may be noticed downstream from the festoon 26.

Controller 52 as shown in FIGS. 1-3 can control the drive device 50B based on information received from the tension sensing device 72. In addition, the controller 52 can use information from the velocity sensing devices 60A and 60B to also control the drive device 50B based on electronic gearing between the spindles 16 and 18 and the guide roll 42E. In this manner, the drive device 50B can follow the spindle speed based on a scaled factor during a splicing event.

During operation, the controller 52, which may comprise one or more microprocessors, can control both drive devices 50A and 50B based on changes in web speed and web tension. Typically during processing, small adjustments are made to the rotational speed of the guide rolls 42A and 42E based upon speed changes of the web 20. Web tension fluctuations sensed by the web tension devices 25 and 70 can be used to further control the drive devices 50A and 50B for accelerating or decelerating the corresponding guide rolls 42A and 42E. In general, the drive devices 50A and 50B can be controlled independently of one another.

For example, if a web tension decrease or increase is sensed by the tension sensing device 25, the controller 52 can control the drive device 50A for increasing or decreasing the rotational speed of the guide roll 42A. Similarly, if tension sensing device 70 senses a decrease in web tension or an increase in web tension, the controller can control the drive device 50B for decreasing or increasing the rotational speed of the guide roll 42E.

In the embodiment illustrated in the figures, the system includes two drive devices 50A and 50B that each accelerate and/or decelerate a corresponding guide roll. It should be understood, however, that the system can include more drive devices if desired. In fact, a drive device can be associated with all or any of the guide rolls 42 or 44 located within the festoon 26.

Referring to FIGS. 1-3, a splice sequence using the method and system of the present disclosure is illustrated. During a splice sequence or other interruption in the process, the method and system of the present disclosure are designed to maintain web tension within defined limits while speed changes of the web of material occur upstream. Thus, the system of the present disclosure is designed to maintain web tension within a predetermined range even though the speed of the web being unwound into the process changes dramatically with respect to the speed of the web after the festoon being fed into the process.

During a splice sequence, a first roll of material is spliced to a second roll of material so that the second roll of material can be fed through the process. During a splice sequence, it is desirable that the downstream speed of the material remain unchanged. Referring to FIG. 1, the system of the present disclosure is shown in steady-state operation. During steady-state operation, the drive devices can remain inactive. As illustrated, a first roll of material 12 is being unwound and fed into the festoon 26 prior to entering a downstream process. A staging roll 14 is also shown that is intended to replace the first roll of material 12 when the first roll of material is exhausted. The festoon has accumulated material to be fed into the process during the splice sequence.

When it is time to splice the second roll 14 to the first roll 12, in one embodiment, the unwind speed of the material 20 is increased. When this occurs, the carriage 46 of the festoon 26 moves away from the bottom guide rolls 42 causing a greater accumulation of material to occur within the festoon (see the arrow in FIG. 1). Next, the unwind speed of the material 20 is decelerated or stopped. A splicing device 24 then splices a material to the first material.

During the interruption in the winding process, the carriage 46 of the festoon 26 moves towards the bottom set of guide rolls 42 releasing material that was stored in the festoon as shown in FIG. 2.

During the deceleration of the material 20, certain guide rolls in the festoon 26 also decelerate. For instance, if the speed of material 20 was to stop, the guide rolls within the festoon would vary in speed from zero at guide roll 42A to the downstream speed of the material at the guide roll 72.

During the sequence, the drive devices 50A and 50B may be activated by the controller based on information received from the tension sensing devices and the velocity sensing devices causing the corresponding guide rolls to decelerate. For example, the tension sensing devices 25 and 70 may indicate that tension in the web of material 20 is increasing due to a reduction in the velocity of the web of material being unwound. The controller can be configured to control tension within a range. When one of the tension sensing devices indicates that the tension in the web has increased above a predetermined setpoint, the controller can then control the drive devices 50A and 50B for decelerating the corresponding guide rolls 42A and 42E in order to reduce the increased tension and bring the tension of the web back into a predetermined range.

Referring to FIG. 3, after a splice has occurred, the unwind device unwinds the second roll of material 14 into the process. At this point in the splice sequence, the carriage 46 continues to collapse until the spindle and guide rolls are accelerated back to line speed. The spindle speed or unwind speed of the material is then adjusted in order to bring the festoon carriage back to the run position if necessary. For instance, optionally, the material 20 may be fed into the festoon at a speed that is greater than the downstream speed of the material. When this occurs, the carriage 46 of the festoon 26 moves away from the bottom guide rolls 42 causing an accumulation of material to occur within the festoon.

During this sequence of events, the guide rolls 42 may be accelerated. During acceleration of the material 20, the drive devices 50 may be activated by the controller causing the corresponding guide rolls to accelerate. For instance, the tension sensing devices 25 and/or 70 may indicate to the controller that the tension of the web is below a setpoint. In response, the controller can control the drive devices 50A and 50B for accelerating the corresponding guide rolls 42A and 42E in order to increase tension in the web back into a desired range. During these adjustments, the controller can also receive information from the velocity sensing devices 60A and 60B and also make adjustments in the rotational speed of the guide rolls. As explained above, matching the velocity of the web of material at the unwind location with the velocity of the material at the guide rolls can prevent against tension fluctuations and better minimize the amount of corrections that need to take place when tension fluctuations are observed.

In addition to splice sequences, the system and process of the present disclosure may be used during other processing conditions, such as during process startup and shutdown events.

As explained above, the position of the drive devices, the number of drive devices, and the position of the tension sensing devices can vary depending upon the particular application and the desired result. For instance, in one embodiment, greater than two drive devices may be incorporated into the system, such as greater than three drive devices, such as greater than four drive devices. In one embodiment, for instance, a drive device can be associated with each and every guide roll within the festoon. In addition, drive devices can be associated with guide rolls upstream from the festoon and downstream from the festoon. Referring now to FIGS. 4-9, various other embodiments of web handling systems made in accordance with the present disclosure are shown. Like reference numerals have been used to indicate similar elements.

Figure 4:
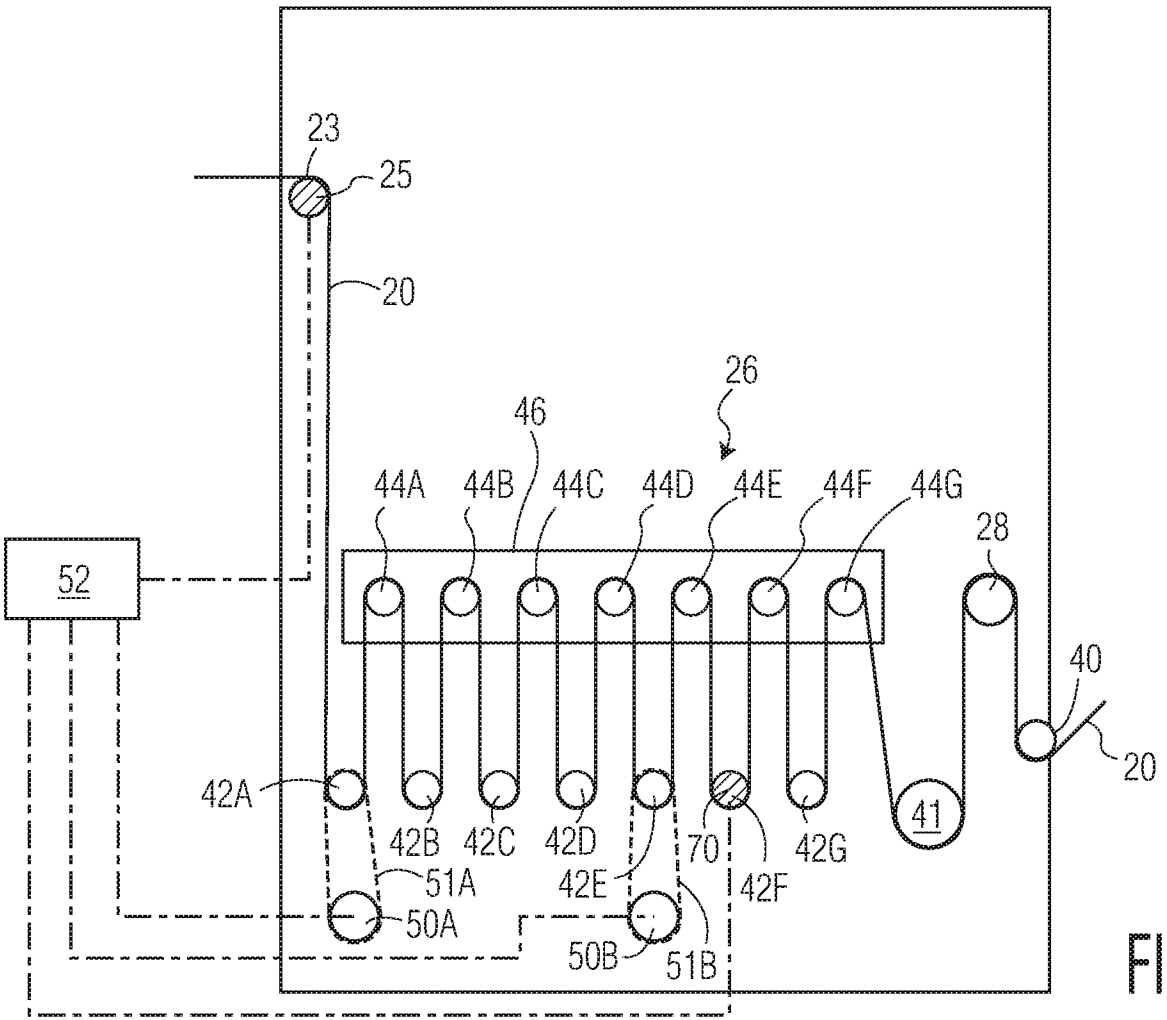
FIG. 4 is a side view of another embodiment of an unwind system made in accordance with the present disclosure.

The embodiment illustrated in FIG. 4, for instance, is similar to the embodiment illustrated in FIG. 1. The tension sensing device 70, however, is shown as a load cell associated with a guide roll 42F located within the festoon 26. In both FIG. 1 and FIG. 4, the tension sensing device 70 is positioned downstream from the drive device 50B. It should be understood, however, that in other embodiments the tension sensing device 70 may be positioned upstream from the drive device 50B.

Figure 5:
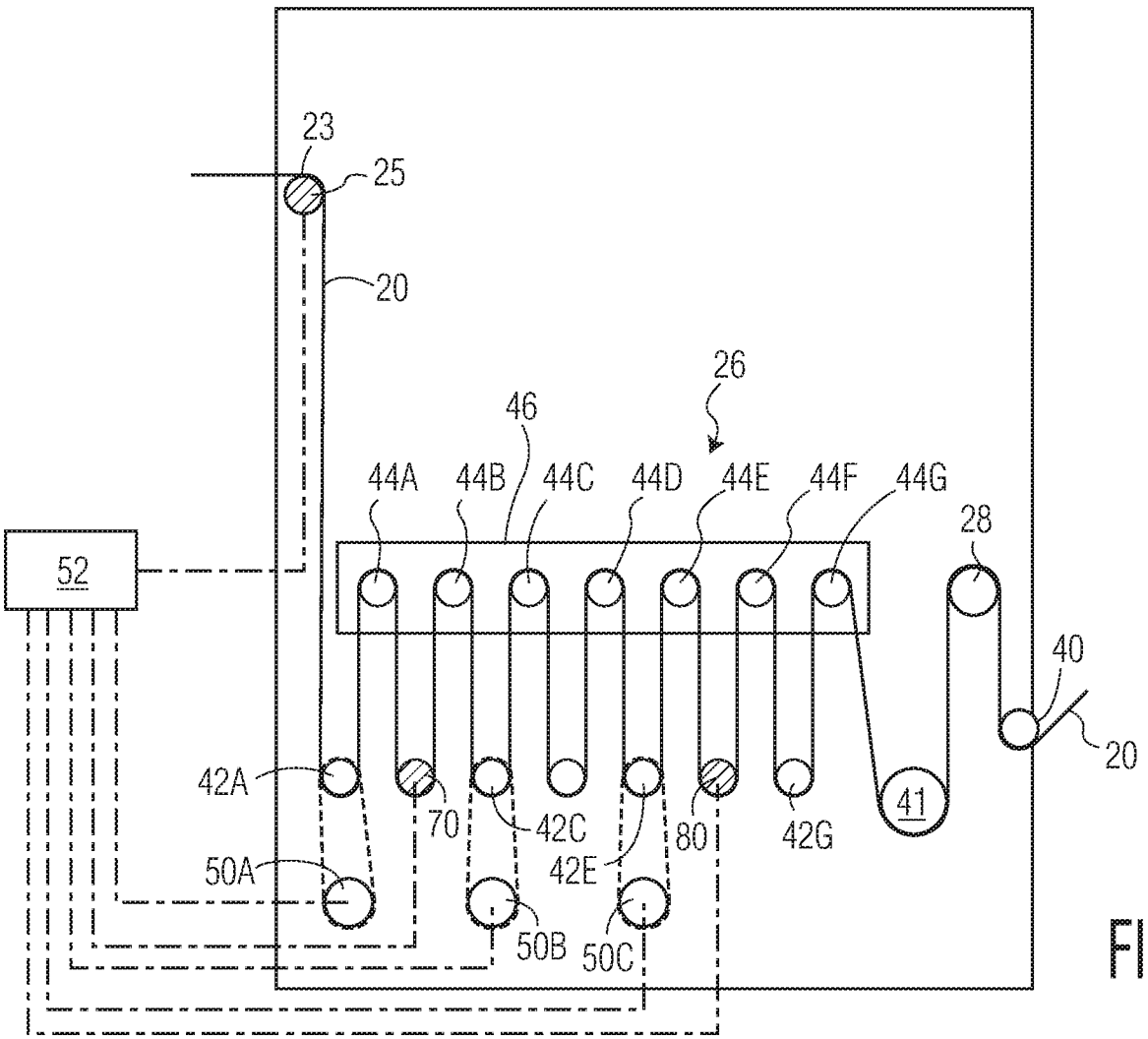
FIG. 5 is a side view of another embodiment of an unwind system made in accordance with the present disclosure.

Referring to FIG. 5, another embodiment of a system made in accordance with the present disclosure is shown. In the embodiment illustrated in FIG. 5, the system includes three drive devices 50A, 50B and 50C that are coupled to three corresponding guide rolls 42A, 42C and 42E.

Similar to the embodiment illustrated in FIG. 1, the drive device 50A is associated with a tension sensing device 25 and the drive device 50B is associated with a tension sensing device 70. In the embodiment illustrated in FIG. 5, however, the tension sensing device 70 is positioned upstream from the drive device 50B. In the embodiment illustrated in FIG. 5, the system further includes a third drive device 50C that is associated with a third tension sensing device 80. The tension sensing device 80 is positioned downstream from the drive device 50C. In other embodiments, however, the tension sensing device 80 can be positioned upstream from the drive device 50C. In the embodiment illustrated in FIG. 5, guide rolls 42A, 42C and 42E can all be accelerated and decelerated independently of each other during processing in order to maintain tension in the web of material 20 within preset limits.

Figure 6:
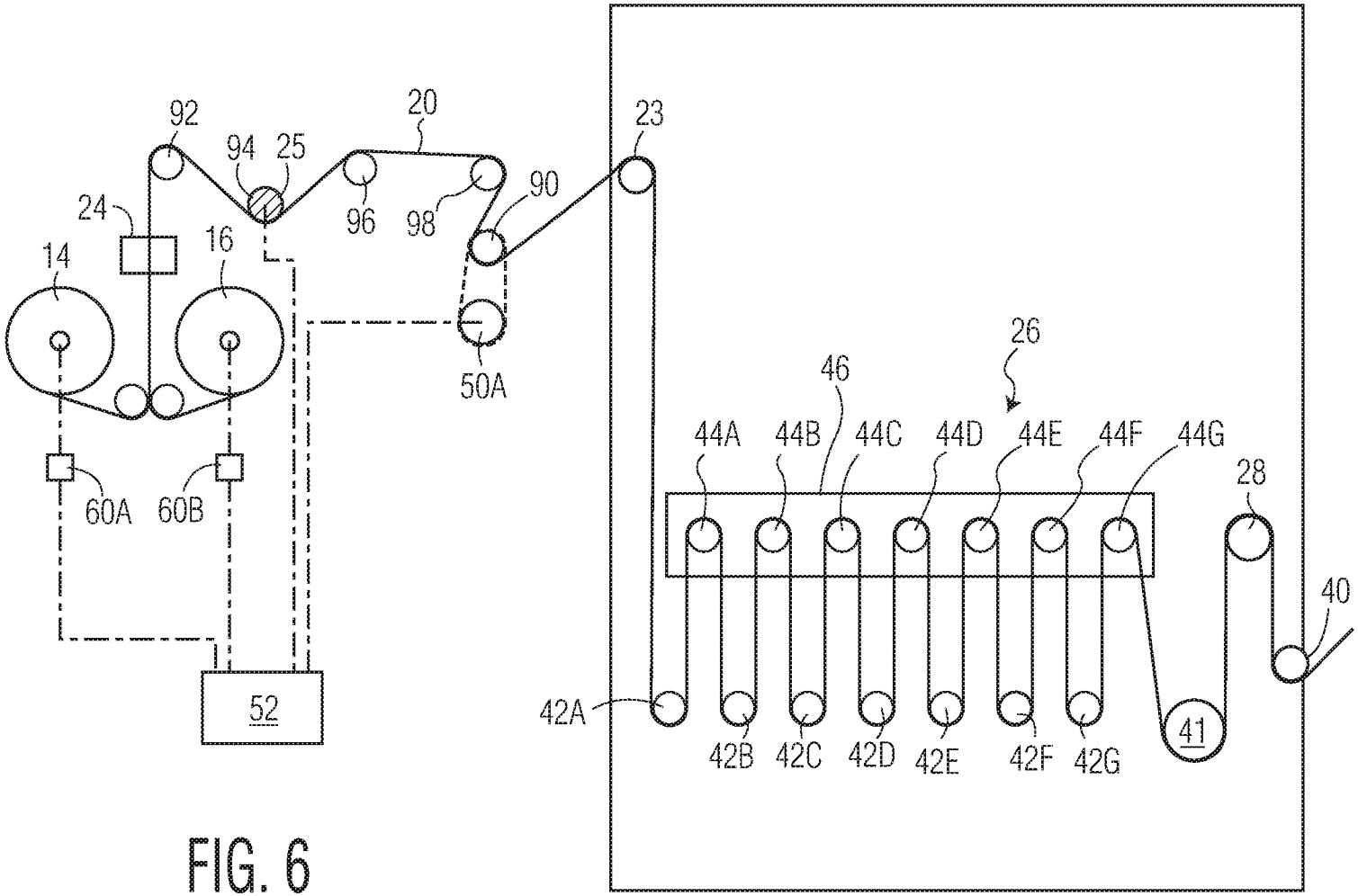
FIG. 6 is a side view of another embodiment of an unwind system made in accordance with the present disclosure.

As described above, in one embodiment, the drive device and driven guide roll can be positioned outside of the festoon 26. For instance, as shown in FIG. 6, a drive device 50A is positioned upstream from the festoon 26. In the embodiment illustrated in FIG. 6, a series of guide rolls 92, 94, 96, 98, 90, and 23 are positioned upstream of the festoon 26 and are designed to guide the web of material into the festoon. The drive device 50A is shown coupled to the guide roll 90. In addition, the system includes a tension sensing device 25 that can be a load cell associated with guide roll 94. A controller 52 can receive information from the tension sensing device 25 and monitor the tension in the web of material. When the tension within the web of material is outside preset ranges, the controller can control the drive device 50A for accelerating or decelerating the guide roll 90 in order to increase or decrease tension in the web. For instance, in one embodiment, the guide roll 90 can be accelerated in order to increase tension and can be decelerated in order to decrease tension.

Figure 7:
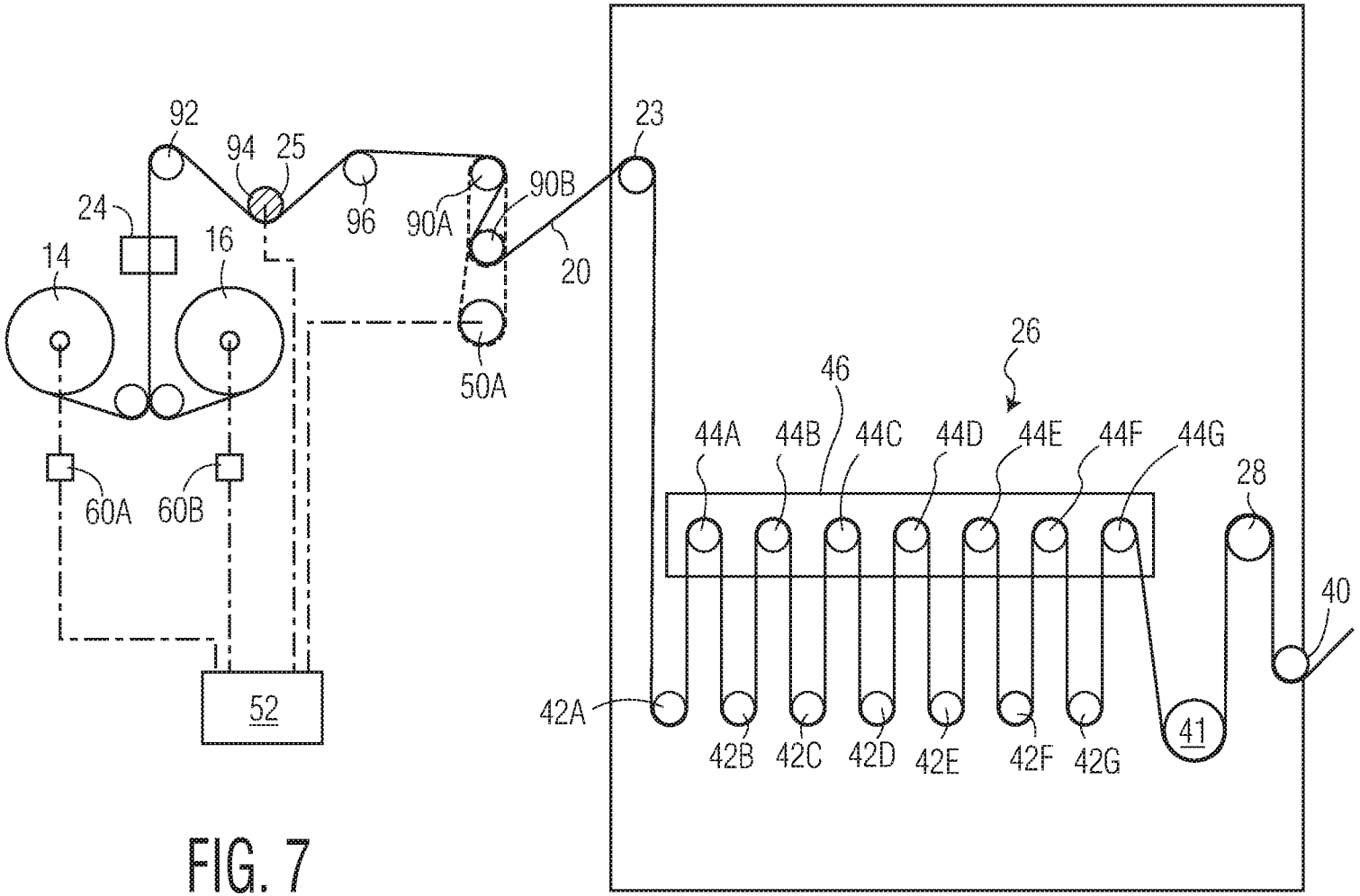
FIG. 7 is a side view of another embodiment of an unwind system made in accordance with the present disclosure.

Referring to FIG. 7, still another embodiment of a web handling system in accordance with the present disclosure is shown. The system illustrated in FIG. 7 is similar to the system illustrated in FIG. 6. In FIG. 7, however, the drive device 50A is coupled to two guide rolls 90A and 90B. The guide rolls 90A and 90B are positioned such that the web of material 20 has an S-wrap configuration when guided around the two rolls 90A and 90B. The drive device 50A is coupled to both rolls for accelerating or decelerating both rolls simultaneously in order to increase or decrease web tension when the tension of the web is outside preset limits.

Figure 8:
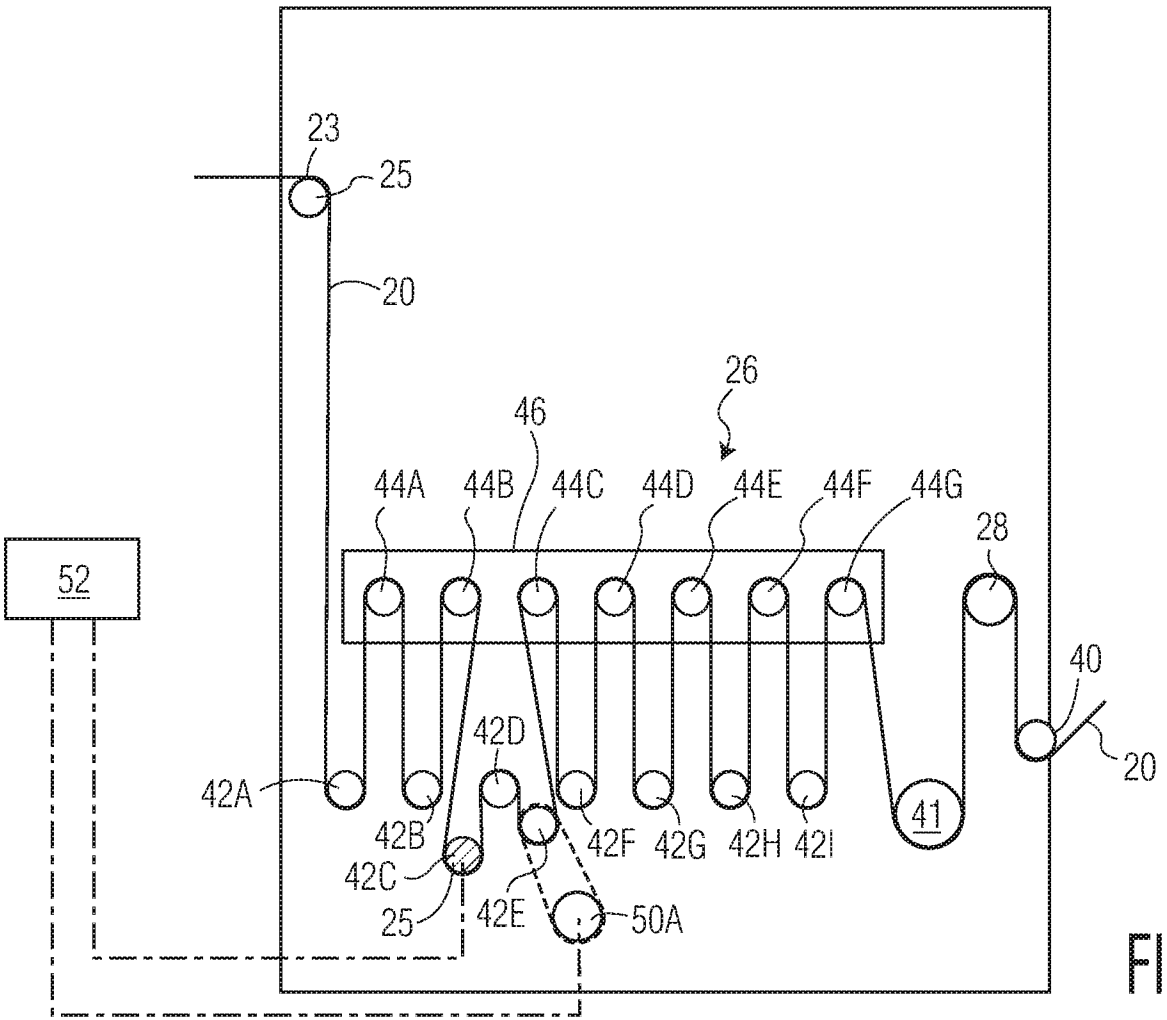
FIG. 8 is a side view of another embodiment of an unwind system made in accordance with the present disclosure.

Referring to FIG. 8, still another embodiment of a web handling system in accordance with the present disclosure is shown. In the embodiment illustrated in FIG. 8, the system includes a single drive device 50A. The drive device 50A is coupled to a guide roller 42E. In addition, the system includes a tension sensing device 25 that is associated with a guide roll 42C. In the embodiment illustrated in FIG. 8, the drive device 50A and the driven roll 42E are located in the middle of the festoon 20. The tension sensing device 25 is also associated with a guide roll 42C within the festoon. As also shown in FIG. 8, the guide rolls 42C and 42E are somewhat out of alignment with the other guide rolls within the festoon. Positioning the guide rolls in a manner shown in FIG. 8 may improve the accuracy and responsiveness of the system.

Figure 9:
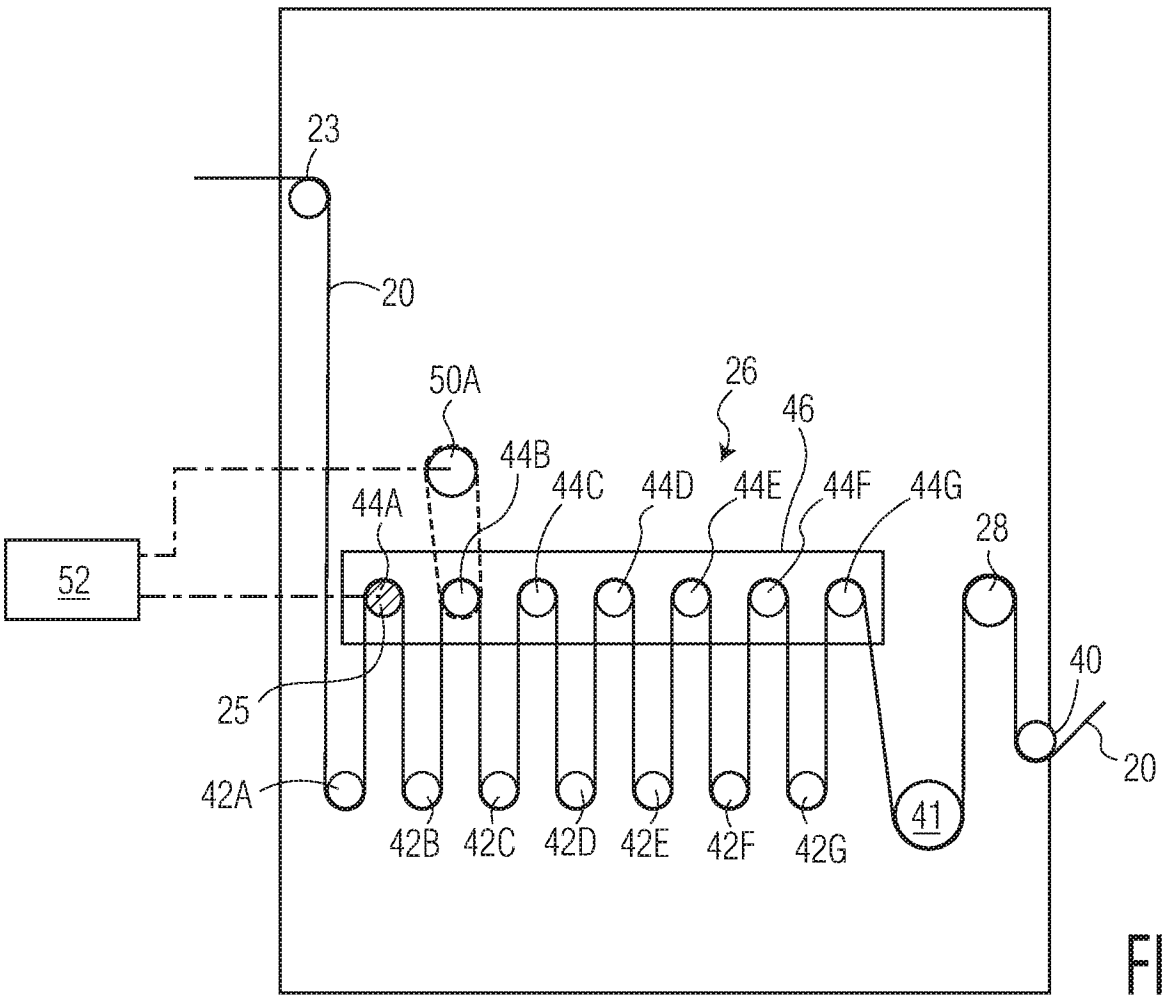
FIG. 9 is a side view of another embodiment of an unwind system made in accordance with the present disclosure.

Referring to FIG. 9, still another embodiment of a web handling system in accordance with the present disclosure is shown. In FIG. 9, the system includes a drive device 50A that is coupled to a guide roller 44B. The system further includes a tension sensing device 25 placed in association with the guide roll 44A. In the embodiment illustrated in FIG. 9, the driven guide roll 44B is positioned on the carriage 46 along the upper set of guide rolls.

As stated above, the system of the present disclosure may be used to unwind various materials including nonwovens, wovens, elastic materials, polymeric films, adhesive tapes, mechanical fastening materials, paper webs, and the like. In one embodiment, the system of the present disclosure may be used to unwind materials during the formation of an absorbent article, such as diapers, training pants, incontinence articles and pads, feminine hygiene products, and the like. For example, the system and method of the present disclosure can be used to produce absorbent articles that include an absorbent structure positioned in between a liner material and an outer cover material. The system and process of the present disclosure, for instance, may be used to feed the liner material and/or the outer cover material into a process line for producing absorbent articles.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A web handling system comprising:

a web feeding device including at least one guide roll;

a tension sensing device that monitors tension in a web of material being fed to the web handling system;

a festoon positioned downstream from the web feeding device and the tension sensing device, the festoon comprising a first set of guide rolls spaced from a second set of guide rolls, the first set of guide rolls and the second set of guide rolls being movable towards and away from each other;

a drive device coupled to one of the guide rolls in the first set of guide rolls or second set of guide rolls forming a driven guide roll in the festoon downstream from the tension sensing device, the drive device configured to individually control the driven guide roll; and a controller configured to receive information from the tension sensing device and, based on the information received from the tension sensing device, control the drive device in order to rotationally accelerate or decelerate the driven guide roll for controlling tension in a web of material.

2. A web handling system as defined in claim 1, wherein the tension sensing device comprises a load cell.

3. A web handling system as defined in claim 2, wherein the load cell is in operative association with an idler roll positioned upstream from the driven guide roll.

4. A web handling system as defined in claim 1, wherein the drive device comprises a motor that is coupled to the driven guide roll by a direct drive, by a belt, by a gearbox, or by a chain.

5. A web handling system as defined in claim 1, wherein the web feeding device comprises an unwind device for unwinding a roll of material, the unwind device being located upstream from the tension sensing device.

6. A web handling system as defined in claim 5, further comprising a velocity sensing device for monitoring a velocity of a web of material being unwound from the unwind device, the velocity sensing device being in communication with the controller, the controller receiving information from the velocity sensing device and, based on the information from the velocity sensing device, controlling the drive device in a manner such that the velocity of the web of material being unwound from the unwind device substantially matches the velocity of the web of material travelling over the driven guide roll.

7. A web handling system as defined in claim 6, wherein the velocity sensing device monitors a rotational speed of a spindle holding the roll of material being unwound, and wherein the web handling system is configured to calculate the velocity of the web of material being unwound from the rotational speed of the spindle.

8. A web handling system as defined in claim 6, wherein the velocity sensing device comprises a non-contact speed sensor or a contact speed sensor.

9. A web handling system as defined in claim 5, wherein the web handling system includes a first unwind device for unwinding a first roll of material and a second unwind device for unwinding a second roll of material, the system further including a splicing device for splicing the roll of materials together.

10. A web handling system as defined in claim 1, wherein the web handling system further comprises a second tension sensing device; and wherein the drive device comprises a first drive device and a second drive device, and the driven guide roll comprises a first driven guide roll and a second driven guide roll;

the first drive device coupled to the first guide roll;

the tension sensing device being in communication with the controller and wherein the controller is configured to receive information from the tension sensing device and, based on the information received from the tension sensing device, control the first drive device in order to accelerate or decelerate the first driven guide roll;

the second drive device coupled to the second guide roll; and the second tension sensing device being in communication with the controller and wherein the controller is configured to receive information from the second tension sensing device and, based on the information received from the second tension sensing device, control the second drive device in order to accelerate or decelerate the second driven guide roll.

11. A web handling system as defined in claim 10, wherein the second tension sensing device is positioned downstream or upstream from the second guide roll.

12. A web handling system as defined in claim 10, wherein the drive device comprises a third drive device, the web handling system further comprising a third tension sensing device, and the driven guide roll comprises a third driven guide roll; the third drive device coupled to the third guide roll, the third tension sensing device being in communication with a controller and wherein the controller is configured to receive information from the third tension sensing device and, based on the information received from the third tension sensing device, control the third drive device in order to accelerate or decelerate the third driven guide roll.

13. A web handling system as defined in claim 1, wherein the controller comprises one or more microprocessors.

14. A web handling system as defined in claim 10, wherein the first drive device and the second drive device both comprise motors and wherein the tension sensing device and the second tension sensing device both comprise load cells.

15. A web handling system as defined in claim 1, wherein the first set of guide rolls and the second set of guide rolls in the festoon include an upstream guide roll, a plurality of midstream guide rolls, and a downstream guide roll, the drive device being coupled to the upstream guide roll.

16. A web handling system as defined in claim 1, wherein the tension sensing device is located upstream from the festoon.

17. A process for unwinding a roll of material into a downstream process comprising:

unwinding a roll of material from an unwind device, the roll of material comprising a web of material;

monitoring tension in the web of material being unwound at a first location with a tension sensing device;

feeding the web of material into a festoon positioned downstream from the tension sensing device, the festoon including a plurality of rotatable guide rolls through which the material being unwound is threaded, the festoon including an upstream guide roll, a plurality of midstream guide rolls, and a downstream guide roll, the festoon accumulating a length of the web of material between the guide rolls; and actively accelerating or decelerating one of the guide rolls based upon the monitored tension in the web, the guide roll being actively rotationally accelerated or decelerated using a drive device individually coupled to the guide roll, the guide roll being rotationally accelerated or decelerated in order to control tension of the web.

18. A process as defined in claim 17, further comprising the steps of monitoring a velocity of the web of material being unwound from the roll at the unwind device and controlling the upstream guide roll with the driving device in order to substantially match the velocity of the web of material at the unwind device with the velocity of the web of material at the upstream guide roll.

19. A process as defined in claim 18, wherein the roll of material is unwound from a spindle and wherein a rotational speed of the spindle is monitored in order to determine the velocity of the web of material being unwound.

20. A process as defined in claim 19, wherein electronic gearing is used to determine the velocity of the web of material from the rotational speed of the spindle.

21. A process as defined in claim 17, further comprising the steps of:

decreasing the rate at which the roll of material is unwound at the unwind device causing material accumulated in the festoon to be released downstream;

splicing a second roll of material to the material being unwound during the decrease in rate;

actively decelerating the guide roll in the festoon when the rate at which the first roll of material is unwound decreases based upon the monitored tension; and after splicing the second roll of material to the first roll of material, accelerating the second roll of material using a second unwind device and actively accelerating the guide roll in order to follow a speed of the unwinding material and control tension in the material.

22. A process as defined in claim 17, further comprising the steps of:

monitoring tension in the web of material at a second location; and actively accelerating or decelerating a second guide roll based upon the monitored tension in the web of material at the second location.

23. A process as defined in claim 22, wherein the second guide roll is actively accelerated or decelerated by a second driving device that is coupled to the roll.

24. A process as defined in claim 22, wherein the second guide roll is a midstream guide roll.

* * * * *